US006000883A

United States Patent [19]

Irvine et al.

[11] Patent Number: 6,000,883

[45] Date of Patent: Dec. 14, 1999

[54] SHEET PILING EXTRUSION

[76] Inventors: John E. Irvine, Atlanta; John J. Yeosock, Dunwoody, both of Ga.

[21] Appl. No.: 09/033,783

[22] Filed: Mar. 3, 1998

[51] Int. Cl.[6] ..... E02D 3/02; E02D 5/02

[52] U.S. Cl. ..... 405/281; 405/274; 405/278

[58] Field of Search ..... 405/274–281, 405/267

[56] References Cited

U.S. PATENT DOCUMENTS

| | | | |
|---|---|---|---|
| 972,059 | 10/1910 | Clarke . | |
| 1,422,821 | 7/1922 | Boardman et al. . | |
| 1,679,800 | 8/1928 | Wemlinger . | |
| 1,804,436 | 5/1931 | Rendleman | 405/278 |
| 1,837,787 | 12/1931 | Meiser | 405/279 |
| 1,841,759 | 1/1932 | Nolte | 405/218 |
| 1,884,686 | 10/1932 | Hilpert . | |
| 2,090,728 | 8/1937 | Heide . | |
| 2,968,931 | 1/1961 | McGrath . | |
| 3,247,673 | 4/1966 | Schneller . | |
| 3,822,557 | 7/1974 | Frederick . | |
| 3,999,392 | 12/1976 | Fukushima et al. . | |
| 4,632,602 | 12/1986 | Havnanian | 405/128 |
| 4,674,921 | 6/1987 | Berger | 405/262 |
| 4,690,588 | 9/1987 | Berger | 405/262 |
| 4,808,039 | 2/1989 | Fischer | 405/281 |
| 4,863,315 | 9/1989 | Wickberg | 405/278 |
| 5,066,353 | 11/1991 | Bourdo | 156/300 |
| 5,106,233 | 4/1992 | Breaux | 405/128 |
| 5,145,287 | 9/1992 | Hooper et al. | 405/242 |
| 5,163,785 | 11/1992 | Zanelli et al. | 405/277 |
| 5,292,208 | 3/1994 | Berger | 405/281 |
| 5,333,971 | 8/1994 | Lewis | 405/281 |
| 5,360,293 | 11/1994 | Breaux et al. | 405/267 |
| 5,388,931 | 2/1995 | Carlson | 405/274 |
| 5,580,191 | 12/1996 | Egan | 405/262 |
| 5,584,610 | 12/1996 | Simpson et al. | 405/281 |

OTHER PUBLICATIONS

Materials International, Inc., Atlanta, GA, GeoGuard Vinyl Sheet Piling Advertisement, 6 pp.

Materials International, Inc., Atlanta, GA, ShoreGuard Vinyl Seawalls Advertisement, 12 pp.

Waterloo Barrier, Inc., Rockwood, Ontario, Canada, Sealable Joint Sheet Piling Advertisement, 4 pp.

Canadian Metal Rolling Mills, Cambridge, Ontario, Canada, Case History No. W104 Advertisement, 2 pp.

Canadian Metal Rolling Mills, Cambridge, Ontario, Canada, Case History No. W106 Advertisement, 22 pp.

Materials International, Inc., Atlanta, GA, ShoreGuard Vinyl Sheet Piling, 14 pp.

Northstar Vinyl, Woodstock, GA, Nov. 4, 1997, 2 pp.

Steel Sheet Piling Handbook, Reference Data on Shapes, Materials, Performance and Applications, United States Steel Co., pp.: cover page, inside cover page, 5–7, 9, 12, 13, 28–53.

USS Steel Sheet Piling, United States Steel, including pages: cover page, inside cover page, 8–20 and 22–39.

*Primary Examiner*—Dennis L. Taylor

*Attorney, Agent, or Firm*—Thomas, Kayden, Horstemeyer & Risley

[57] ABSTRACT

An extruded sheet piling (20) is disclosed. The sheet piling has a planar body panel (22) with a top end (23) and a spaced bottom end (24). A first continuous side edge (26) and a second spaced parallel continuous side edge (27) extend between the top end and the bottom end of the body panel, respectively. A first planar flat (29) extends away from the first side edge of the body panel, and has an elongate continuous male locking member (31) formed along an outside edge (30) thereof A second spaced parallel flat (34) extends away from the second side edge of the body panel, and has a female locking member (36) extending the length of an outside edge (35) and which is sized and shaped to snugly receive the male locking member of an adjacent sheet piling therein. An elongate structural reinforcing rib (42) is extruded as a part of the sheet piling along the outside edge of the first flat, and is spaced from and parallel to the male locking member.

10 Claims, 4 Drawing Sheets

SHEET PILING EXTRUSION

FIELD OF THE INVENTION

This invention relates in general to an improved sheet piling extrusion adapted for use in forming continuous retaining walls, sea walls, and the like. More particularly, the invention relates to an improved sheet piling extrusion having an elongate reinforcing rib formed as a part of a male locking member of the extrusion for increasing the strength and resistance to bending of the sheet piling when used with adjacent ones of the sheet piling for forming a continuous retaining wall and the like.

BACKGROUND OF THE INVENTION

The use of aluminum and steel sheet piling, as well as the use of treated timber, to include timber beams and planking, in constructing retaining walls, sea walls, and the like is well known. Aluminum and steel sheet piling has the advantage of being rigid, however aluminum and steel sheet piling is expensive, and over time, particularly when exposed to the elements, the aluminum and steel will corrode such that retaining walls formed of these sheet pilings need to be periodically maintained, and/or replaced. Treated timber on the other hand, tends to be less expensive and thus more cost effective than aluminum and/or steel sheet pilings, and may provide a satisfactory service life dependent upon the usage for which the retaining wall is constructed. However, a problem that arises with the use of treated timber is that it has been banned in a great many areas due to its toxicity, and treated timber is experiencing substantially reduced service life due to increased marine borer activity.

Due to the aforementioned problems or using aluminum, steel, or treated timber retaining walls, the use of plastic or vinyl extruded sheet piling has become a popular option for use in forming retaining walls and sea walls. Extruded vinyl and plastic sheet pilings offer the advantage of being lightweight, less expensive than steel sheet pilings, and can also be extruded in a variety of architectural shapes and styles for a greater blend of utilitarian purpose and aesthetics than is available with rolled steel sheet pilings. Examples of such plastic sheet pilings are disclosed in U.S. Pat. No. 4,690,588 to Berger; U.S. Pat. No. 4,863,315 to Wickberg, and U.S. Pat. No. 5,145,287 to Hooper, et al. U.S. Pat. No. 5,066,353 to Bourdo discloses a fiberglass sheet piling which offers the advantages of being less costly to fabricate than an extruded sheet piling, yet has the significant disadvantage of being more brittle such that if struck by a blunt force, for example a driftwood log if used in a sea wall, or by a vehicle if used to construct a retaining wall, the fiberglass panels could easily be cracked or destroyed.

Although plastic sheet pilings offer the advantage of being rugged, durable, inexpensive, and easy to use, they have the distinct disadvantage of being more flexible, i.e. having less structural rigidity than do steel sheet pilings. As known to those skilled in the art, a steel sheet piling will have a modulus of elasticity approximately 75 times greater than that of a plastic sheet piling. In most applications, the section thickness of an extruded sheet piling can be made thinner or thicker dependent on the end usage in which the sheet piling will be used, such that the disadvantage of a plastic sheet piling with regard to the structural rigidity of a steel sheet piling is minimized. However, in increasing the section thickness of an extruded plastic sheet piling, this necessarily results in increased costs and weight, which may impact the economic decision to use a plastic sheet piling in lieu of a steel sheet piling in the first instance. Three examples of an extruded plastic sheet piling based on the plastic panel erosion barrier disclosed in Hooper, et al are disclosed in FIGS. 1A–1C. These vinyl sheet pilings are also known as the ShoreGuard® family of vinyl sheet piling manufactured and sold by Materials International, Inc. of Atlanta, Ga.

As illustrated in FIGS. 1A–C then, three extruded sheet pilings 5, 5' and 5" are disclosed, each of which is constructed in an almost identical fashion, although they differ in terms of the geographic profile formed by the extruded sheet piling. Thus, each one of these three sheet pilings has an elongate planar body panel 7 having a first continuous side edge 8, and a second continuous side edge 9. Extending from the first side edge 8 is a first flat section, known to those in the industry as a flat, having a continuous male locking member 12 formed along its outside edge opposite the first side edge of the body panel. As shown in FIGS. 1A and IB, the male locking member 12 is situated at the end of an arcuate section 13 formed along the outside edge of the first flat 11.

The sheet piling of FIGS. 1A–C has a second flat section 15, known as a second flat, extending away from the second side edge 9 of the body panel. A complimentarily shaped female locking member 16 is formed along the length of an outside edge of the second flat opposite the second side edge of the body panel. The two flats 11 and 15 extend in directions opposite one another and away from body panel 7, and are positioned parallel to one another such that a reversible profile is formed, in which, for example, respective adjacent ones of the sheet pilings 5, 5', and 5" can be placed in top end to top end, or top end to bottom end interlocked edge-standing relationship with respective ones of the extrusions 5, 5', and 5".

As shown in FIGS. 1A and 1B, each male locking member 12 is formed as a generally T-shaped member, whereas the female locking member 16 is formed as a substantially C-shaped member. In the embodiment of FIG. 1C, however, the male locking member 12" is formed to have two outwardly projecting portions sized and shaped for being received within a substantially circular female locking member 16".

Although the embodiments of the prior art sheet pilings shown in FIGS. 1A–1C have proven to be a significant improvement over the sheet pilings and the vinyl plastic sheet pilings known in the art, the problem remains that due to the greater flexibility of an extruded plastic sheet piling, the flats 11 and 15 will tend to bend or deflect about a central bending axis or plane extending between the two flats in response to the application of a static or dynamic load or force against the flat. Although the interlocked edge-standing relationship of the male locking member within the female locking member of an adjacent sheet piling tends to add some structural rigidity to a plastic sheet piling retaining wall, the problem still exists that if an unexpected load is placed against the sheet piling the male locking member may be pulled out of the adjacent female locking member, and/or that the retaining wall could bow or flex, perhaps destructively so, dependent upon the loads being transmitted against the wall.

What is needed, therefore, but seemingly unavailable in the art is an extruded plastic sheet piling constructed and arranged to be placed into an interlocked edge-standing relationship with adjacent ones of the extruded sheet piling which will have a greater degree of structural rigidity than those extruded sheet pilings known in the art. What is also needed is such an improved sheet piling extrusion which will increase the strength of the interlocked male and female locking member joint to increase the pull-out strength of the interlocked male and female locking members. Additionally, there is a need for such an improved plastic sheet piling which will be balanced about its centroid such that the flow of the plastic material through an extrusion die is balanced, and so that the cooling of the extruded sheet piling will also be balanced about the centroid such that torsional forces which would otherwise tend to twist or flex the sheet piling extrusion as it cools will be greatly mitigated, if not eliminated entirely.

SUMMARY OF THE INVENTION

The present invention provides an improved sheet piling extrusion which overcomes some of the design deficiencies of other extruded sheet piling panels known in the art. The present invention discloses an elongate planar body panel having a top end, a spaced bottom end, with a continuous first side edge and a spaced parallel second side edge extending from the top end to the bottom end of the panel, respectively. A first planar flat extends away from the body panel along the first side edge, and a second planar flat extends away from the body panel along the second side edge. A central bending plane extends through the body panel parallel to, and positioned between the first and second flats, respectively. A male locking member is formed along the outside edge of the first flat opposite the first side edge of the body panel, and a complimentary female locking member is formed along an outside edge of the second flat opposite the second side edge of the body panel, the female locking member being sized and shaped to snugly receive the male locking member therein.

An elongate reinforcing rib which also functions as a driving tongue is formed as an integral part of the extrusion and extends away from, and along the outside edge of the first flat, being spaced from and parallel to the male locking member such that it extends perpendicularly with respect to the central bending plane for adding structural rigidity to the sheet piling extrusion when in use as a retaining wall, a sea wall, or the like. The reinforcing rib and the male locking member together form a substantially I-shaped or H-shaped member in cross-section such that not only the structural rigidity of the sheet piling is improved but the strength of the interlocked male and female locking members of adjacent ones of the sheet pilings is improved resulting in increased strength for resisting pull-out forces which may be applied against the interlocked sheet pilings. So constructed, the reinforcing rib is sized and shaped to at least partially enclose the female locking member of a second, adjacent, sheet pilings when received in an interlocked edge-standing relationship with the male locking member of the sheet piling with respect to which the reinforcing rib is formed.

The sheet piling is a one-piece extrusion, preferably extruded of plastic, the plastic being either virgin or recycled polyvinylchloride, polyethylene, polypropylene, and polyurethane, although polyvinylchloride is preferred. The sheet piling extrusion is also reversible, such that it can be placed in a top end to top end interlocked edge-standing relationship, or a top end to bottom end interlocked edge-standing relationship with adjacent ones of the sheet piling extrusion.

Moreover, by the addition of the reinforcing rib to the outside edge of the first flat, the sheet piling can be constructed such that it is balanced about its centroid, i.e. its center of mass, while being extruded for allowing a more uniform flow of the material being forced through the extrusion die, and which will allow the extruded sheet piling to avoid problems in differential heat retention as it cools, which in turn will balance the shrinkage of the extrusion, and thus improve the tolerances of the sheet piling, and will also tend to minimize flexure, twisting, or bending in the sheet piling which may result from an unbalanced extrusion.

It is, therefore, an object of the present invention to provide an improved sheet piling having greater strength and resistance to bending or flexure than those extruded sheet pilings known in to the art.

Another object of the present invention is to provide an improved sheet piling which is easier to drive into the earth when forming a retaining wall. sea wall, or the like.

Still another object of the present invention is to provide an improved sheet piling which increases the pull-out strength of the interlocked edge-standing relationship formed between the male locking member and the female locking member of adjacent ones of the sheet piling when in use for forming a retaining wall, sea wall, and the like.

Another object of the present invention is to provide an improved sheet piling which is balanced about its centroid for balancing the flow of material extruded through an extension die for reducing the differential cooling of the extrusion, and thus decreasing the likelihood of the sheet piling bending, twisting or curling during the cooling process.

An additional object of the present invention is to provide an improved sheet piling which can be manufactured of a virgin or recycled plastic.

Still another object of the present invention is to provide an improved sheet piling which is rugged and durable in structure and use. is simple in design, and is easy to manufacture and use.

These, as well as the other objects, features, and advantages of the present invention will become apparent, therefore, upon reading the following specification, when taken in conjunction with the accompanying drawings.

DETAILED DESCRIPTION OF THE PREFERRED EMBODIMENT

Figure 1A:
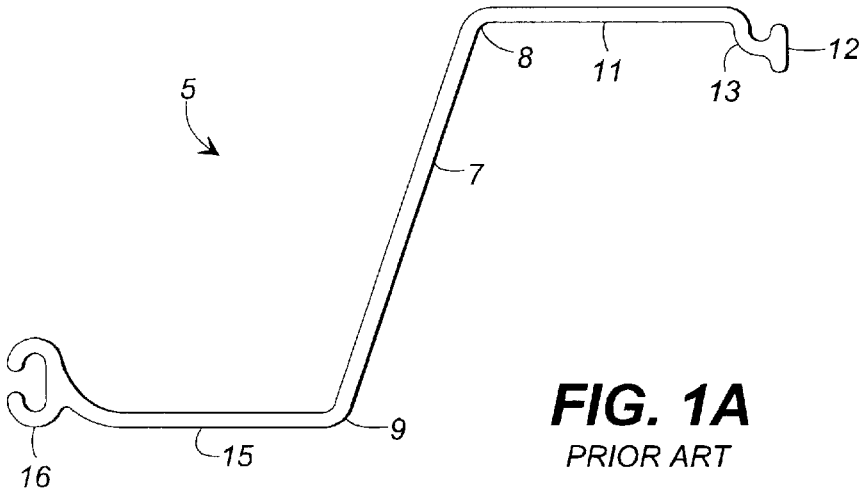
FIG. 1A PRIOR ART
FIG. 1A is a plan view of a first embodiment of a prior art sheet piling extrusion.
Figure 1B:
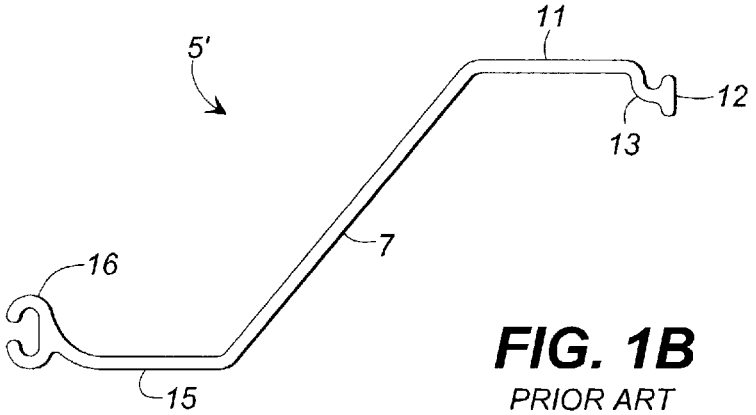
FIG. 1B PRIOR ART
FIG. 1B is a plan view of a second embodiment of a prior art sheet piling extrusion.
Figure 1C:
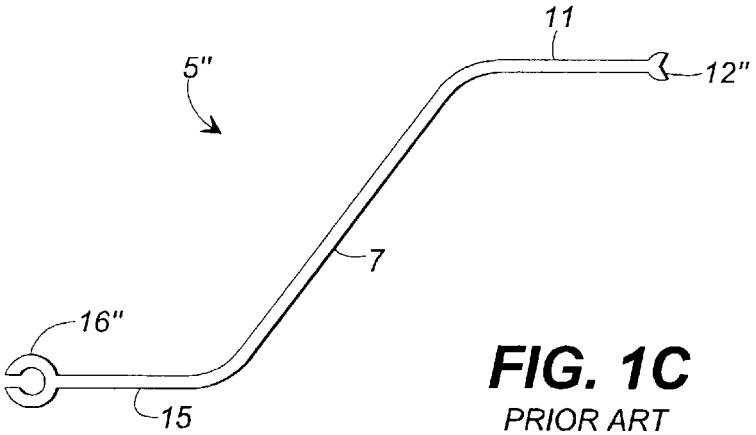
FIG. 1C PRIOR ART
FIG. 1C is a plan view of a third embodiment of a prior art sheet piling extrusion.
Figure 2:
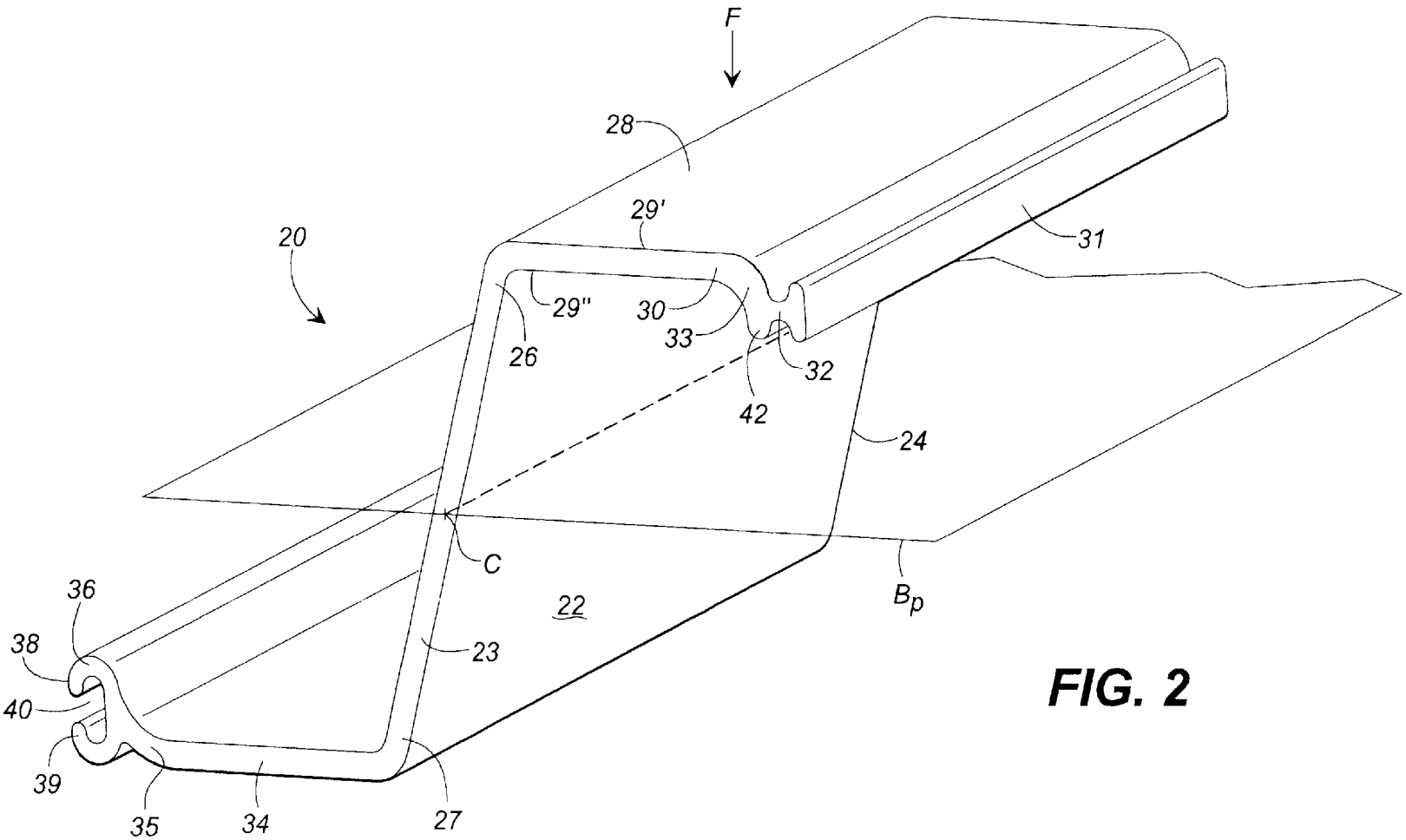
FIG. 2 is a top, front perspective view of a preferred embodiment of the sheet piling extrusion of this invention, and of the bending plane extending through the centroid of the sheet piling.
Figure 3:
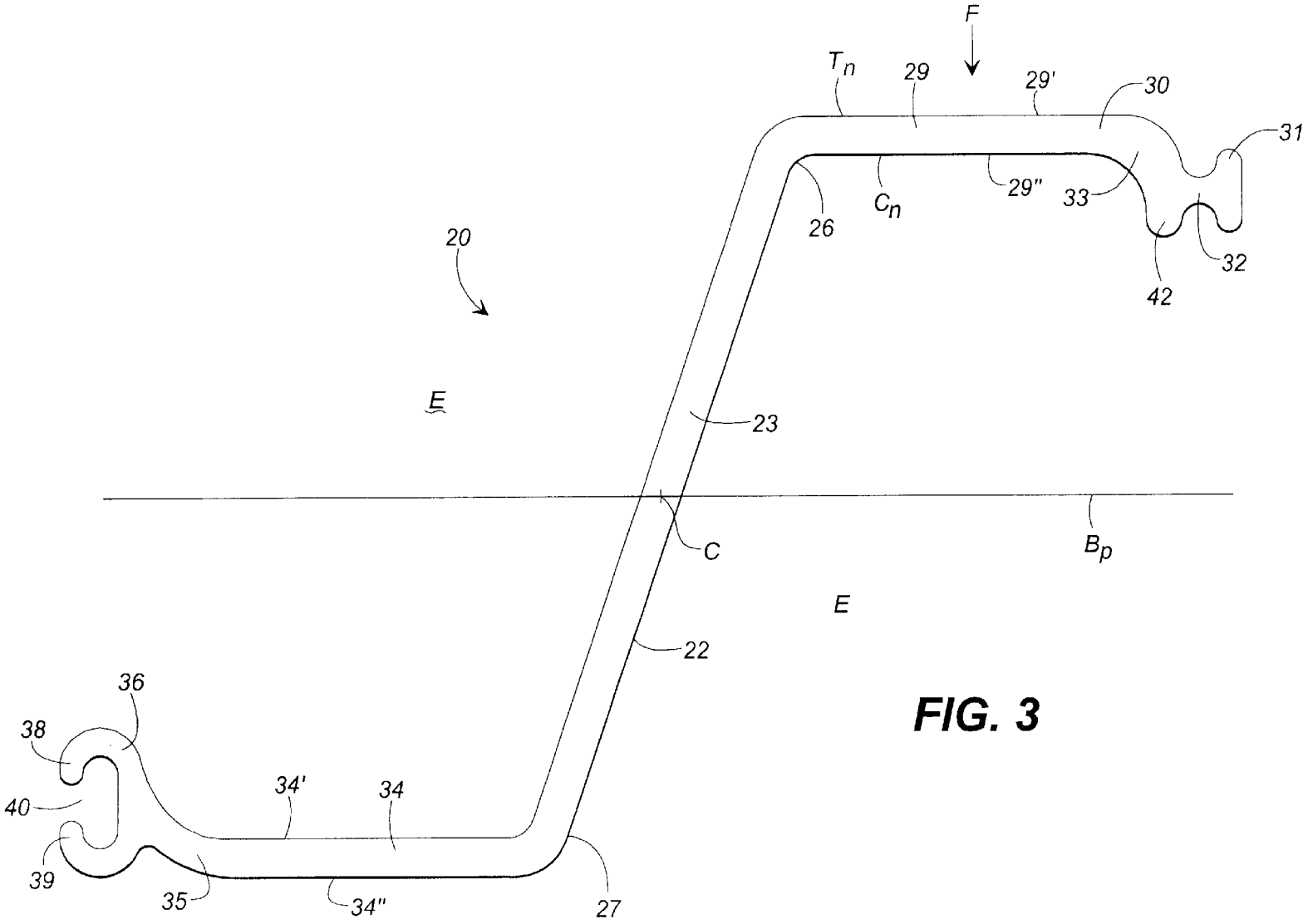
FIG. 3 is a plan view of the sheet piling extrusion of FIG. 2.
Figure 4:
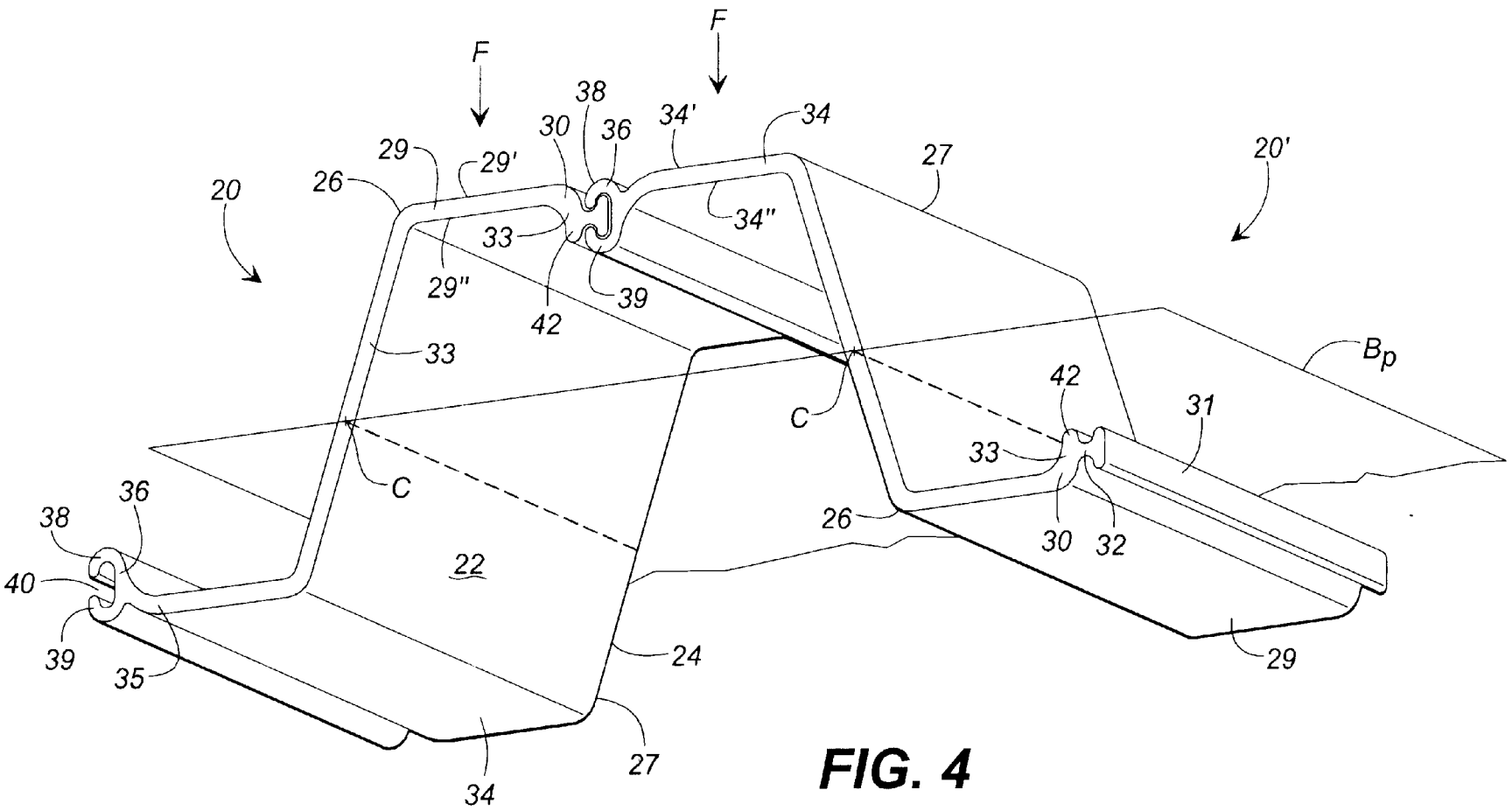
FIG. 4 is a front, top perspective view of an identical pair of the extrusions of FIGS. 1 and 2 shown in an interlocked edge-standing top end to bottom end relationship, and the bending plane extending through the respective centroids of the two sheet piling extrusions.

Referring now to FIGS. 2–4, in which like reference characters indicate like parts throughout the several views, a preferred embodiment of the improved sheet piling extrusion 20 of this invention is disclosed, hereinafter referred to as the "sheet piling". The sheet piling shown in FIGS. 1–4 has an elongate planar body panel 22 with a top end 23 and a spaced bottom end 24. Extending between the respective top and bottom ends of the body panel is a first continuous side edge 26, and a second continuous spaced, parallel side edge 27. A first flat section, or flat as known to those of skill in the art, 29 extends along the length of first side edge 26, and extends to an outside edge 30 spaced from and parallel to the first side edge 26 of the body panel. A T-shaped male locking member 31 is formed along the outside edge of the first flat, and extends from a neck 32, the neck itself extending from an arcuate section 33 formed along the outside edge of the first flat.

A second planar elongate flat 34 is formed along the second side edge 27 of the body panel, and has a continuous outside edge 35 spaced from and parallel to the second side edge of the body panel. A C-shaped female locking member 36 extends along the length of the outside edge 35 of the second flat 34. The female locking member 36 includes a pair of arcuate lips 39, 39 which extend away from the outside edge 35 of second flat 34, and arc toward one another to define an elongate continuous C-shaped channel 40 therebetween, channel 40 being sized and shaped to allow the passage of neck 32 therethrough as one of male locking members 31 is received within the female locking member. Although the female locking member 36 in FIGS. 2–4 is shown as being substantially C-shaped, it is anticipated that this geometric configuration could just as easily be circular or comprised of any geometric configuration so long as the male and female locking members, respectively, are sized and shaped to be snugly received within an interlocked edge-standing relationship extending the length of the respective outside edges of each one of sheet piling extrusions 20, such as shown in FIG. 4 between a first sheet piling extrusion 20, and a second identical sheet piling extrusion 20', the two sheet pilings being shown in a top end to bottom end interlocked edge-standing relationship. Thus although the male locking member 31 is shown as being T-shaped at the end of neck 32, it is anticipated that the male locking member can be of any complimentarily shaped geometric configuration so long as it is sized and shaped to be snugly received within the female locking member 36 of a second sheet piling extrusion In usage, it is anticipated that a first sheet piling, sheet piling 20 of FIG. 4 for example, would be driven into the earth whereupon a second, and in this instance identical, sheet piling 20' is positioned such that the female locking member 36 thereof is passed over the topmost portion of the male locking member 31, whereupon the second sheet piling extrusion 20' is then driven into the earth as the female locking member 36 is passed over and along the male locking member 31 to form an interlocked edge-standing relationship between the adjacent ones of the sheet pilings 20, 20'. As shown in FIG. 4, these two sheet pilings are shown in a top end to bottom end interlocked edge-standing relationship. Although not illustrated, it is anticipated that adjacent ones of the sheet pilings can be placed in a top end to top end interlocked edge-standing relationship, or a top end to bottom end interlocked edge-standing relationship, in any desired pattern or configuration as desired, for the purposes of forming a continuous retaining wall, sea wall, or the like.

The preferred embodiment of the sheet piling extrusion of this invention includes a unique elongate continuous reinforcing rib 42 formed along the outside edge 30 of the first flat portion 29 of the sheet piling. Reinforcing rib 42 is an elongate continuous structural member which is spaced from and parallel to the male locking member 31 of each such sheet piling so that together with neck 32 the reinforcing rib, the male locking member, and the neck form a substantially I-shaped member in cross-section, as best shown in FIG. 3, in which the male locking member 31 and the reinforcing rib 42 both extend perpendicular to a bending plane, denoted by the reference character $B_p$, in FIGS. 2–4. So constructed, reinforcing rib 41 in conjunction with male locking member 31 greatly improves the structural rigidity of the sheet piling in fashion heretofore unknown in the art for plastic extruded sheet pilings.

Sheet piling 20, 20' is preferably a one-piece plastic extrusion. The extrusion may be formed of either virgin or recycled plastic, and is preferably extruded of polyvinylchloride ("PVC"), although other plastics including, but not limited to, polyethylene, polypropylene, and polyurethane may be used when extruding the sheet piling. A unique feature of reinforcing rib 42 of sheet piling 20 is that the inclusion of the reinforcing rib "balances" the extrusion about its centroid, i.e., its center of mass, denoted by the reference character "C" in FIGS. 2–4, such that the mass of extruded plastic about the centroidal axis C of FIGS. 2–4 is balanced. By balancing the extrusion on either side of the centroid, this will in turn balance the weight, thickness, and width of the extrusion about the centroid, which will thus reduce the differential heat retention of the sheet piling from side-to-side as it cools, which in turn will balance the shrinkage from side-to-side during the cooling process after extrusion and will prevent the sheet piling from bowing, curling, or twisting as it cools. This is a particularly important advantage attained through the inclusion of reinforcing rib 42 in that relatively tight tolerances within the interlock formed by a male locking member 31 and a female locking member 36 are present so that a snug fit along the length of the respective male and female locking members is attained, which leaves little space for variation in the linear bowing or flexing of the sheet piling over the length of its extruded sheet.

Moreover, by balancing the extrusion about the centroid C, this improves the structural rigidity of the sheet piling by increasing the overall section modulus of the sheet, and in particular improves the section modulus of the sheet piling at the I-shaped portion of the sheet piling formed by male locking member 31, neck 32. and reinforcing rib 42. The extrusion of reinforcing rib 42 with the sheet piling 20 increases the strength of the male locking member 31 due to the perpendicular orientation of the reinforcing rib with respect to the bending plane, which for reasons described in greater detail below, greatly improves not only the strength, but also the resistance to bending or flexure of the sheet piling about the bending plane than that of other extruded plastic sheet pilings known in the art. Additionally, the inclusion of the reinforcing rib and the resulting H-shaped configuration increases the pull-out strength of the interlocked edge-standing relationship of sheet pilings 20, 20' of FIG. 4, for example, by providing greater resistance against allowing either one or both of the lips 38, 39 of the female locking member 36 to flex or spread apart in that the reinforcing rib partially encloses at least one of the lips of the female locking member between the reinforcing rib and the male locking member 31. By structurally supporting the sheet piling on both sides of at least lip 39 in FIG. 4, for example, less bending force is allowed to be transmitted to the lips of the female locking member, which acts to prevent the interlocked edge-standing relationship of the male and female locking members from spreading apart or opening up as an unexpected force is applied against the respective first flat 29 and second flat 34 of the adjacent interlocked edge-standing sheet piling extrusions 20, 20'.

An additional advantage of extruding an integral reinforcing rib 42 with the sheet piling, and of balancing the extrusion about the centroid, is that this also balances the driving resistance between the sheet piling and the soil through which the sheet piling is driven during installation to maintain a vertical alignment of the sheet piling. Were the additional strength of the reinforcing rib not present, it is possible. and it has happened with prior art extruded sheet pilings, that the sheet piling might flex along its length intermediate the top and bottom ends of the extrusion as it is driven into the earth where, in particular, the sheet piling has difficulty moving through the earth, for example it strikes a rock or other relatively solid structure buried in the earth, such that the force driving the top end of the sheet piling, or the bottom end as the case may be, into the earth will tend to buckle or warp the male locking member, or the female locking member somewhere along its length due to the fact that plastic extrusions, as described above, have a modulus of elasticity less than that of steel. By extruding the reinforcing rib and spacing it with respect to the male locking member 31 of each sheet piling extrusion, the likelihood that the panel will flex or bend as it is driven into the earth is greatly reduced, such that a solid interlocked edge-standing "lock" between the two adjacent sheet pilings will be formed to ensure superior performance over the other sheet piling extrusions, and retaining walls formed thereof, known in the art. Moreover. the improved rigidity of the H-shaped configuration of the reinforcing rib 42, neck 32 and male locking member 31 transfers more of the axial driving forces through the sheet to the leading edge of the sheet being driven into the earth, to again ensure knowing that the panel does not flex, and that if an obstruction is encountered by the leading end of the sheet piling extrusion, it will tend to be forced or moved out of the way by the driving forces being used to drive the sheet piling into the earth.

The sheet piling shown in FIGS. 2–4 may be of any desired thickness,. although it is anticipated that it will generally fall within a range of from 0.20" to 0.40", although this may be greater or less dependent upon the applications or usage for which the sheet pilings will be used, as well as the chemical composition of the sheet piling, the length of the sheet piling, and the depth to which the sheet piling will be driven. In all instances, however, the extrusion of the reinforcing rib 42 with the sheet piling greatly improves the performance characteristics of the sheet piling in the fashion described above.

Another problem which results with the use of extruded plastic sheet pilings, as touched upon briefly above, is that due to its diminished modulus of elasticity when compared to steel, plastic will tend to flex or bend when a force is applied against it, for example against flats 29 or 34, such that the flats will want to bend toward a bending plane, denoted by the reference character $B_P$, in FIGS. 2–4, the bending plane extending through the centroid of the sheet piling and being parallel to the flats 29, 34 of each sheet piling extrusion. As shown in cross-section, in FIG. 3, for example, the bending plane appears as a bending axis.

Referring therefore to FIGS. 2–4, and in particular to FIG. 3, assuming that the sheet piling has been driven into the earth, denoted by the reference character "E" in FIG. 3, over time a force, denoted by the reference character "F", will be exerted against the inside surface 29' of flat 29 such that surface 29' is placed in a compressive loading situation, whereas a tensile loading situation is exerted along surface 29'. As known to those of skill in the art, plastic, and particularly PVC, has an exponentially larger compressive strength as compared to its tensile strength. It is therefore the tensile capacity of the plastic that is the limiting factor in maximizing the load carrying capacity of flat 29. If the force F applied to surface 29', for example, resulted in a tensile loading of surface 29" that exceeded the maximum allowable tensile capacity that precludes creep failure of the plastic along surface 29", then the plastic would plastically deform or stretch and a destructive failure of a portion, or perhaps all of the retaining wall would occur. By extruding reinforcing rib 42 as part of flat 29, however, especially so that it extends perpendicularly with respect to the bending plane, and is positioned adjacent surface 29", a substantially greater tensile loading capacity is achieved by increasing the mass of surface 29" and the associated increase of the section modulus of flat 29.

Thus, by balancing the extrusion of the sheet piling about the centroid C, this also maximizes the potential load carrying capacity of the sheet piling. As known to those skilled in the art, the limiting factor for load carrying capacity is the allowable tensile stress, which occurs at the outer edge or fibers of the sheet piling, shown for example along surface 29' of flat 29 in FIG. 3. When the sheet piling is formed symmetrically about its centroid, as shown in FIGS. 2–4, the bending plane is at the same location as the centroid and the distance of the flats from the bending plane is at its maximum. The distance of the bending plane from the outer edge of the respective flats can be no larger than half the depth of the sheet piling because the same sheer. piling may be used in alternating fashion, as shown in FIG. 4, in which the two sheet pilings 20, 20' are shown in a top end to bottom edge interlocked edge-standing relationship. If the centroid is offset, it would be true that the capacity on one side of the bending plane of that sheet piling would be increased, but that same orientation would be limited in capacity if a following identical sheet piling was oriented in an opposite hand, as shown in FIG. 4. One side of the piling would be stronger, the other weaker, which would reduce the capacity because this would be the weak link or limiting factor and this would determine the ultimate load carrying capacity of the retaining wall or sea wall formed from the sheet pilings.

As shown in FIGS. 2–4, sheet piling extrusion 20 or 20' has a generally Z-shaped profile, which mirrors that shown in U.S. Pat. No. 5,145,287 to Hooper, et al., the provisions of which are incorporated by reference as if set forth fully herein. Moreover, although flats 29 and 34 are shown extending in opposite directions parallel to one another, it is entirely possible that flats 29 and 34 could extend in a common direction such that a substantially C-shaped profile of the sheet piling is extruded, rather than the Z-shaped profile. whereupon the extrusions could then be placed in a top end to bottom end relationship for forming a stepped C-shaped wall along its length.

Reinforcing rib 42 may be of any desired geometric configuration, so long as it extends perpendicular to bending plane Bp, in order to provide greater structural rigidity to the sheet piling, particularly when placed into a tensile loading situation, such as described hereinabove. By forming identical sheet piling extrusions, each having a reinforcing rib 42, the reinforcing rib will increase the structural rigidity of each interlocked edge-standing lock of each adjacent pair of the sheet pilings. As shown in FIG. 4, for example, force F is shown being exerted against one side of the sheet pilings 20, 20' where, for example, the sheet pilings are joined together to form a continuous retaining wall. If, however, additional sheet pilings joined to the respective female and male locking members of the first and second sheet pilings

20, 20' respectively, are used to form a continuous sea wall, then the reinforcing rib 42 which would be received against the female locking member 36 of extrusion 20 would be placed into a compressive load when struck by wave action, such that the improved strength and performance characteristics of this sheet piling will be fully realized. Thus, a single style or design of a one-piece sheet piling extrusion may suffice for most any instance in which plastic sheet piling extrusions may be used for constructing retaining walls, sea walls. and other such structures.

Moreover, by adding the reinforcing rib 42 along the outside edge 30 of flat 29, the reinforcing rib acts as a structural support positioned with respect to the interlocked edge-standing "lock" extending between two adjacent sheet pilings, sheet pilings 20, 20' of FIG. 4 for example, which is at its weakest where neck 32 is passed between lips 38, 39 of female locking member 36. As described above, so positioned reinforcing rib 42 will partially enclose at least one of the lips 38, 39 of female locking member 36 to increase the resistance to pull-out forces which may be induced through a sudden unexpected or shock load against the sheet pilings, for example the forces applied to the sheet piling during installation.

Thus, in fashion heretofore unknown in the art, the improved sheet piling of this invention provides a single one-piece extrusion which offers far greater structural rigidity, and thus performance than the other extruded sheet pilings known in the art, and the use of which is highly adaptable for use in forming retaining walls, sea walls, or any other type of load bearing/retaining wall constructed of extruded plastic sheet pilings. Accordingly, the weight and price advantages of an extruded plastic sheet piling may be more fully realized due to the improvements in strength or load carrying capability of the sheet piling by extruding the driving tongue as a part thereof. Moreover, although not illustrated hereinabove, it is possible that fiberglass fibers, or synthetic fibers, for example nylon or other plastic fibers, could be mixed with the plastic, for example PVC, of which the sheet piling is extruded for still greater improvements in the structural rigidity of the sheet piling.

While a preferred embodiment of the invention has been disclosed in the foregoing specification, it is understood by those skilled in the art that variations and modifications thereof can be made without departing from the spirit and scope of the invention, as set forth in the following claims. In addition, the corresponding structures, materials, acts, and equivalents of all means or step plus function elements in the claims are intended to include any structure, material, or act for performing the functions in combination with other claimed elements, as specifically claimed herein.

We claim:

1. An extruded structural sheet piling, comprising:

an elongate planar body panel, said body panel having a top end, a bottom end spaced from said top end, a first side edge and a second side edge spaced from and extending parallel to said first side edge, each of said side edges extending from the top end to the bottom end of said body panel, respectively;

a first flat connected to and extending at an obtuse angle away from said body panel along said first side edge;

a second flat connected to and extending away from and along said second side edge, said second flat being spaced from and parallel to said first flat and said first and second flats extending in opposite directions respectively from said body panel and each terminating in an outside edge;

a central bending plane extending parallel to and between said first flat and said second flat, respectively;

an elongate reinforcing rib formed on said outside edge of said first flat and extending normal to said first flat and toward said central being plane;

a male locking member extending in parallel spaced relationship with respect to said reinforcing rib and supported from said reinforcing rib with an intermediate neck, with said male locking member, said reinforcing rib and said intermediate neck forming and H-shaped configuration, said neck being located to one side of said flat;

a female locking member formed along the outside edge of the second flat opposite the second side edge of the body panel, said female locking member being spaced from and parallel to said male locking member and of complementary interlocking shape with respect to said male locking member; and said sheet piling being formed about a centroid so that as said sheet piling is extruded the mass of said sheet piling panel is balanced about said centroid;

whereby adjacent ones of such sheet pilings can be interlocked along the respective male and female locking members thereof to form a continuous retaining wall.

2. The sheet piling of claim 1, wherein said reinforcing rib is sized and shaped to at least partially enclose the female locking member of a second one of said sheet pilings against said male sealing member.

3. The sheet piling of claim 1, wherein said male locking member and said neck are substantially T-shaped and sized to be slidably received within the female locking member of an adjacent sheet piling, and wherein said female locking member is substantially C-shaped and sized to slidably receive said neck and said male locking member of an adjacent sheet piling therein.

4. An extruded structural sheet piling for use in forming a continuous retaining wall, said sheet piling comprising:

an elongate planar body panel having a top end, a spaced bottom end, and a first side edge and a spaced parallel second side edge extending from the top end to the bottom end of said body panel, respectively;

a first flat extending at a first obtuse angle away from said body panel along said first side edge and terminating in an outside edge;

a second flat extending at a second obtuse angle opposite and equal to the first obtuse angle away from said body panel along said second side edge and terminating at an outside edge;

an elongate reinforcing rib formed on said outside edge of said first flat and extending normal to first flat;

a male locking member extending parallel to said reinforcing rib and supported from said reinforcing rib with an intermediate neck, which said male locking member, said reinforcing rib and said intermediate neck forming an H-shaped configuration, and with said neck being located to one side of said flat and a leg of the H-shape connected to said first flat; and a female locking member formed along the outside edge of said second flat opposite the second side edge of the body panel, said female locking member being spaced from and parallel to said male locking member and of a complementary interlocking shape with respect to the shape of said male locking member;

said sheet piling being formed about a centroid so that as said sheet piling is extruded the mass of said sheet piling panel is balanced about said centroid;

whereby adjacent ones of said sheet pilings can be interlocked along the respective male and female locking members thereof to form the continuous retaining wall.

5. The sheet piling of claim 4, wherein said body panel is formed about a central bending plane extending parallel to and between said first flat and said second flat.

6. The sheet piling of claim 4, wherein said reinforcing rib sized and shaped to at least partially enclose the female locking member of a second one of said sheet pilings.

7. The sheet piling of claim 4, wherein said extrusion comprises a one-piece plastic extrusion selected from one of the group of plastics consisting of polyvinylchloride, polyethylene, polypropylene and polyurethane.

8. An extruded structural sheet piling, comprising:

an elongate planar body panel having a top end, a spaced bottom end, and a first side edge and a spaced parallel second side edge, each said side edge extending from the top end to the bottom end of said body panel, respectively;

a first planar flat extending away from and along said first side edge;

a second planar flat extending away from and along said second side edge, said second flat being spaced from and parallel to said first flat and wherein said flats extend away from each other in opposite directions;

a central bending plane extending parallel to and between said first flat and said second flat, respectively; and an elongate stiffening rib extending away from and along an outside edge of said first flat, said stiffening rib extending perpendicularly with respect to said central bending plane;

a male locking member formed along an outside edge of the first flat opposite the first side edge of the body panel;

a complimentary female locking member formed along an outside edge of the second flat opposite the second side edge of the body panel said female locking member being spaced from and parallel to said male locking member and of complementary interlocking shape with respect to said male locking member;

said stiffening rib and said male locking member being H-shaped with a leg of the H-shape joined to and extending normal with respect to said first flat and arranged to close the female locking member;

said sheet piling being formed about a centroid as it is extruded so that the mass of said sheet piling panel is balanced about said centroid;

whereby adjacent ones of said sheet pilings can be interlocked along their respective male and female locking members to form a continuous retaining wall.

9. The sheet piling of claim 8, further comprising:

a male locking member formed along an outside edge of the first flat opposite the first side edge of the body panel; and a complimentary female locking member formed along an outside edge of the second flat opposite the second side edge of the body panel, said female locking member being spaced from and parallel to said male locking member;

whereby adjacent ones of said sheet pilings can be interlocked along their respective male and female locking members to form a continuous retaining wall.

10. The sheet piling of claim 9, wherein said male locking member is substantially T-shaped and sized to be slidably received within the female locking member of an adjacent sheet piling, and said female locking member is substantially C-shaped and sized to slidably receive the male locking member of an adjacent sheet piling therein.

* * * * *